United States Patent [19]

Popp et al.

[11] 4,262,706

[45] Apr. 21, 1981

[54] LOOM

[75] Inventors: Karl Popp, Rüti; Heinz Schaub, Oberbühren, both of Switzerland

[73] Assignee: Sulzer Brothers Limited, Winterthur, Switzerland

[21] Appl. No.: 964,136

[22] Filed: Nov. 27, 1978

[30] Foreign Application Priority Data

Dec. 2, 1977 [CH] Switzerland ..... 014739/77

[51] Int. Cl.[3] ..... D03D 49/06

[52] U.S. Cl. ..... 139/103; 139/110; 139/114

[58] Field of Search ..... 139/97, 100, 101, 103, 139/109, 110, 114, 115; 66/209, 211

[56] References Cited

U.S. PATENT DOCUMENTS

| | | | |
|---|---|---|---|
| 1,463,966 | 8/1923 | Northrop | 139/110 |
| 1,519,424 | 12/1924 | Thomas | 139/114 |
| 2,539,295 | 1/1951 | Clentimack | 139/110 |
| 2,661,774 | 12/1953 | Kretzschmar | 139/114 |
| 2,966,930 | 1/1961 | Pfarrwaller | 139/114 |
| 3,426,806 | 2/1969 | Pfarrwaller | 66/209 |

FOREIGN PATENT DOCUMENTS

| | | | |
|---|---|---|---|
| 251905 | 1/1912 | Fed. Rep. of Germany . | |
| 864928 | 4/1961 | United Kingdom | 139/103 |

*Primary Examiner*—Henry Jaudon
*Attorney, Agent, or Firm*—Werner W. Kleeman

[57] ABSTRACT

A loom comprising a resiliently arranged tension or whip roll movably mounted transversely with respect to its lengthwise axis. The tension roll serves to generate the tension of the warp threads or ends of a preferably two-part warp beam. The bearing or support means of the tension roll are arranged to be individually movable independently of one another such that the tension roll can be moved into an inclined position.

4 Claims, 6 Drawing Figures

LOOM

BACKGROUND OF THE INVENTION

The present invention relates to a new and improved construction of a loom which is of the type comprising a resiliently arranged tension or whip roll mounted to be movable transversely with respect to its lengthwise axis, this tension roll serving to generate the tensioning of the warp threads or ends of a preferably two-part or bipartite warp beam.

With a prior art loom of this type, for instance as disclosed in Swiss patent No. 342,181, the tension roll is pivotably mounted at the loom or machine frame at two-pivotal levers which are rigidly interconnected with one another by means of a shaft. Upon deflection of the tension roll the latter continuously maintains its spatial position. More specifically, for each position of the tension roll the tension roll shaft extends essentially parallel to the shaft of the pivotal levers.

With this prior art loom it is not possible for the tension roll to follow for instance an increased warp thread tension which appears only at one end of the warp beam and at the remaining region to essentially retain its position. The tension roll cannot assume any inclined position, as such for instance would be desirable for compensating warp thread tensions arising only at discrete regions or zones.

SUMMARY OF THE INVENTION

Therefore, with the foregoing in mind it is a primary object of the present invention to provide a new and improved construction of loom which is not associated with the aforementioned drawbacks and limitations of the prior art construction discussed above.

Yet a further and more specific object of the present invention aims at the provision of a new and improved construction of loom having a tension roll structured such that it is capable of accommodating increased warp thread tensions appearing for instance at only one end of the warp beam.

Still a further significant object of the present invention aims at a new and improved construction of loom having a tension roll which is structured and mounted in a manner that it is capable of positionally shifting both parallel to its lengthwise axis and into inclined positions, depending upon the encountered tension at the warp threads payed-off a warp beam.

Now in order to implement these and still further objects of the invention, which will become more readily apparent as the description proceeds, the loom of the present development is manifested by the features that the bearings or support means for the tension roll are arranged to be movable individually and independently of one another in a manner such that the tension roll can be moved into inclined positions. By virtue of this mobility it is possible for the tension roll also to follow warp thread tensions which act at only one side, such as can particularly arise at a partial warp beam of two partial warp beams located at a loom. It is then possible to scan or otherwise appropriately detect the deflection arising at one end of the tension roll and to correspondingly alter the drive governing the operation of such partial warp beam, in order to thereby again re-establish the same warp thread tension at both partial warp beams.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
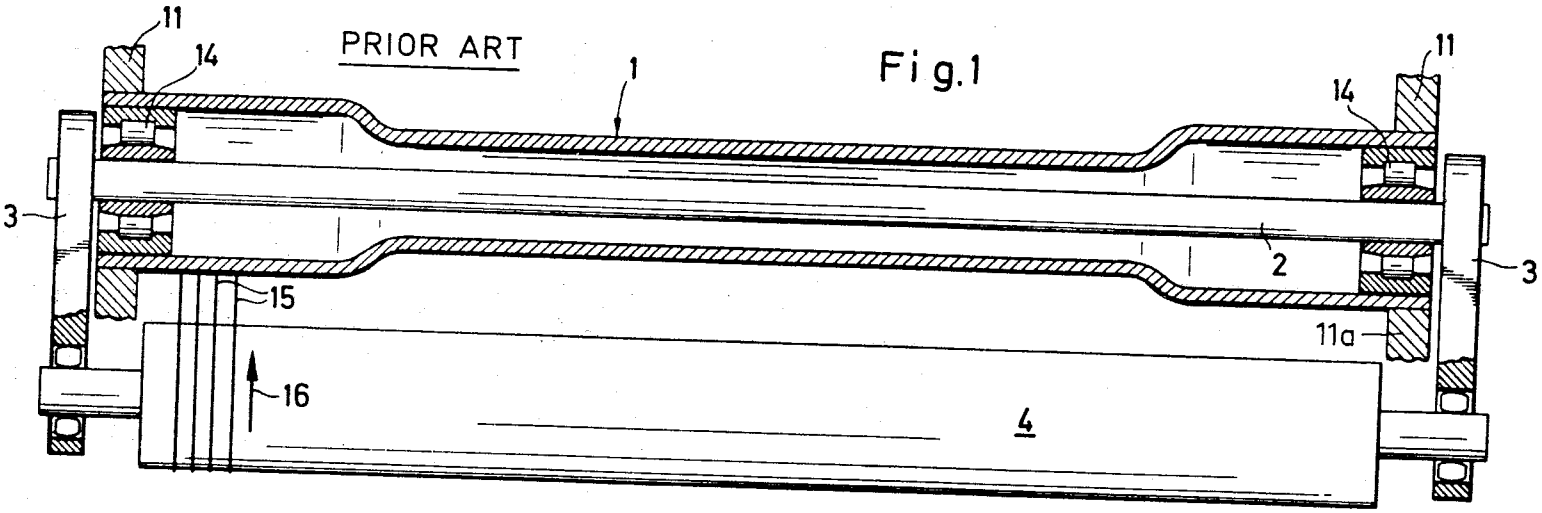
FIG. 1 illustrates in a simplified manner for comparitive purposes a top plan view of a tension roll arrangement of a prior art loom, partially shown in sectional view along the line I—I of FIG. 2.

Describing now the drawings, it is to be understood that only enough of the construction of the loom as deals directly with the teachings of the invention have been shown in the drawings to enable those versed in the art to readily understand the underlying principles and concepts of the invention. Since the invention is predominantly concerned with a novel construction of the tension roll of the loom and its coaction with the warp beam, the illustration has been confined for purposes of simplification to that portion of the loom along with the related components coacting therewith, whereas the remaining portions of the loom may be considered to be conventional and are unimportant to the understanding of the specific teachings of the invention.

Turning attention now to FIG. 1, there is shown therein, for comparative purposes, parts of a prior art loom wherein at both of the side plates or cheeks 11 of the machine or loom frame 11*a* there is mounted within a support beam 1 a shaft 2 while interposing roller bearings 14. Two pivotal levers 3 are mounted at the opposed ends of the shaft 2. Each pivotal lever 3 has an arm 3*a* exposed to the action of a tension spring 5 or equivalent structure. Each such tension spring 5 is attached at its end removed from the lever arm 3*a*, specifically at location 12 at a stationary part 13 of the loom frame 11*a*. The other arm 3*b* of each pivotal lever 3 carries a tension or whip roll 4 over which there are guided the warp threads or ends 15 in the direction of the arrow 16.

Figure 2:
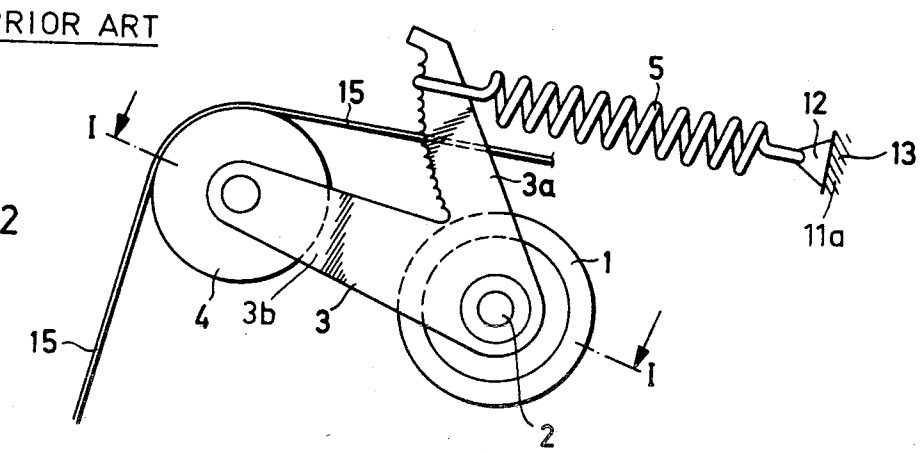
FIG. 2 is a schematic side view of the arrangement of FIG. 1.
Figure 3:
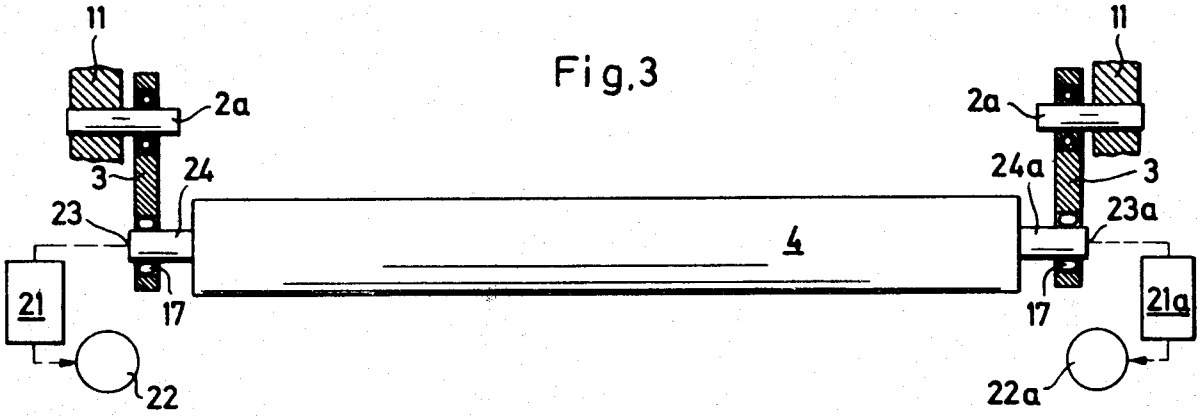
FIG. 3 is a top plan view of the tension roll arrangement of a loom constructed according to the invention.
Figure 4:
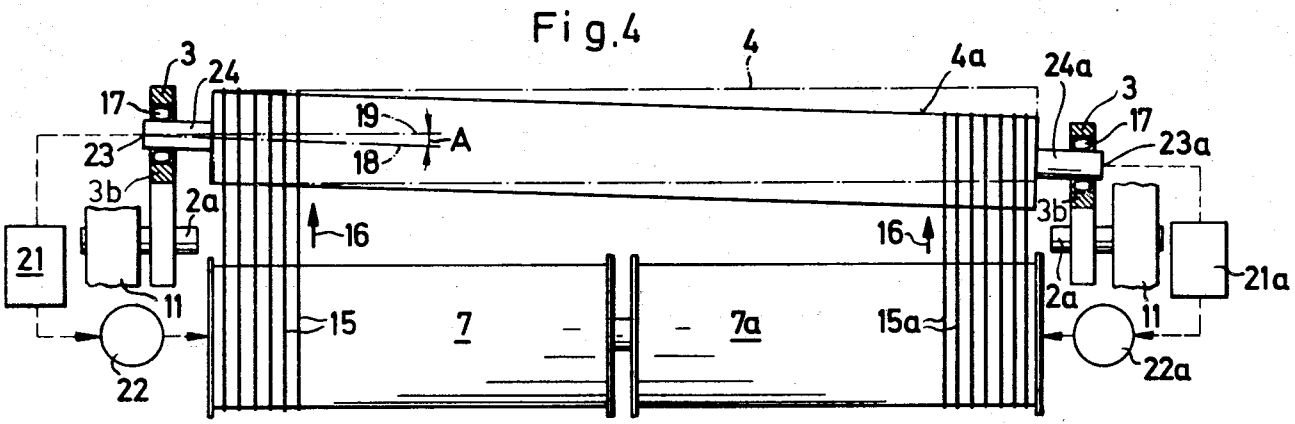
FIG. 4 is a rear view thereof.

Now while with the prior art construction of loom as discussed above in conjunction with FIGS. 1 and 2 the shaft 2 is continuous and forms a rigid connection between both of the pivotal levers 3, with the loom construction according to the invention, particularly as shown in FIGS. 3 and 4, there are used instead of a continuous shaft 2, two shaft ends or portions 2*a*. As a result both of the pivotal levers 3 are individually pivotable independently of one another. With this construction the arms 3*b* are provided with crowned roller bodies 17.

If for instance, as shown in FIG. 4, there are employed two partial warp beams 7 and 7*a* and from which there are payed-off the warp threads or ends 15 and 15*a*, respectively, then if for instance a greater tension is imparted to the warp threads 15*a* than to the warp threads 15, it is possible for the tension roll 4 to be deflected into the inclined position shown in full lines by reference character 4*a* in FIG. 4 and in markedly exaggerated fashion. The lengthwise axis 18 of the tension roll 4 then is located at an angle A with respect to the horizontal axial position 19, i.e., the position assumed by the lengthwise axis of the tension roll 4 shown in phantom lines in FIG. 4 when there is not applied such one-sided tensioning of the warp threads.

Continuing, as shown in FIG. 4 the position of the tension or whip roll 4 can be scanned or detected at both shaft ends 24 and 24*a* of the tension roll shaft at the detection locations 23 and 23*a*, respectively, with the aid of suitable electronic scanning and control devices 21 and 21*a*, respectively, as will be explained more fully hereinafter. Both of the partial warp beams 7 and 7*a* have separate drive motors 22 and 22*a*, respectively. If the tension roll 4 assumes the inclined position 4*a* as shown in FIG. 4 then, for instance, by means of a potentiometer, generally represented by reference character 23*a*, there can be detected the downward deflection of the right-hand end of such tension roll 4 and an appropriate control signal delivered by means of the electronic control device 21*a* to the related drive motor 22*a*. The drive motor 22*a* then is caused to rotate at a higher rotational speed. Consequently, the partial warp beam 7*a* will let-off more warp threads 15*a* than previously, so that the tension roll 4 again, under the action of the spring 5, will assume the essentially horizontal starting position 4. The correction of the tension of the warp threads 15 at the other partial warp beam 7 is accomplished in analogous manner should the tension roll 4 downwardly incline from the right to the left of the showing of FIG. 4. Instead of using potentiometers 23 and 23*a* for detecting positional variations of the respective shaft ends 24 and 24*a* of the tension roll 4, other conventional position detectors can be used as is well known in the electronics art, there being mentioned by way of example inductive or capacitive systems. The detectors, regardless of the nature thereof, must only be capable of sensing a positional change of the tension roll and producing a suitable control signal in response thereto which causes the related control device 21 and 21*a* to appropriately act upon the corresponding drive motors 22 and 22*a*, respectively, of the partial warp beams 7 and 7*a*, respectively.

Figure 5:
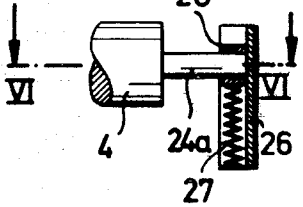
FIG. 5 is a fragmentary top plan view partially in section, of a modified arrangement.
Figure 6:
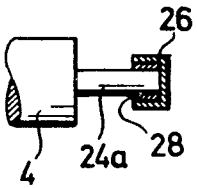
FIG. 6 is a sectional view of the structure of FIG. 5, taken substantially along the line VI—VI thereof.

Furthermore, instead of using movable tension roll bearings 17 arranged at the related pivotal levers 3, it is possible as shown for the modified construction of FIGS. 5 and 6, to movably support both shaft ends 24 and 24*a* of the tension roll shaft in that the same are retained in bearings 28 which are elastically or resiliently structured by virtue of the therewith coacting springs 27 or equivalent structure. In this way it is equally possible for the tension roll 4, when encountering different warp thread tensions, to assume an inclined position, in other words downwardly shift at one end or side thereof.

Furthermore, it should be evident that instead of detecting the deflected position of the tension roll 4, as discussed above for the inclined positions 4*a* shown in full lines in FIG. 4 it would also be possible to detect or scan the angular position of the pivotal levers 3 at the corresponding side of such tension roll 4.

It is also possible to use tension roll bearings 17 which are movable independently of one another in conjunction with a single-part warp beam, i.e., a single warp beam instead of the two-part warp beams 7 and 7*a* shown in FIG. 4.

Both of the drive motors 22 and 22*a* can preferably continuously rotate.

With the inventive construction it is not necessary to provide any differential gearing, as for instance incorporated into the prior art loom disclosed in Swiss Pat. No. 402,763 for the common warp thread let-off drive for two partial warp beams and for compensating the tension of the warp threads of both partial warp beams.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A loom comprising:

a one part tension roll having a lengthwise axis for producing the tension of warp threads payed-off a warp beam;

a two-part warp beam for delivering the warp threads to the tension roll;

means for mounting said tension roll to be movable transversely with respect to its lengthwise axis;

said mounting means comprising a plurality of bearing means, each end of the tension roll being movable individually and independently of one another so as to enable the tension roll to move into an inclined position;

a respective drive for each of both warp beams; and means for individually controlling the drive of each warp beam as a function of each end position of the tension roll.

2. The loom as defined in claim 1, further including:

frame means;

said mounting means further comprising spring-biased pivotal levers mounted at said frame means;

said tension roll-bearing means being arranged at said pivotal levers;

a separate shaft end provided for each end of said tension roll and mounted at the frame means; and each pivotal lever being arranged at a related one of said separate shaft ends.

3. The loom as defined in claim 2, further including:

a two-part warp beam for delivering the warp threads to the tension roll.

4. The loom as defined in claim 1, wherein:

said tension roll-bearing means comprise crowned bearing roller bodies.

* * * * *